US007766551B2

(12) United States Patent
Jansen et al.

(10) Patent No.: US 7,766,551 B2
(45) Date of Patent: Aug. 3, 2010

(54) ROTOR BLOCK

(75) Inventors: Gregor Jansen, Bottrop (DE); Thomas Düllmann, Hagen (DE); Rainer Woyck, Wetter (DE); Jörg Lindemaier, Rinteln (DE); Winfried Gievers, Wetter (DE); Hans-Hermann Osthoff, Wetter (DE)

(73) Assignee: Demag Cranes & Components GmbH (DE)

( * ) Notice: Subject to any disclaimer, the term of this patent is extended or adjusted under 35 U.S.C. 154(b) by 768 days.

(21) Appl. No.: 10/590,103

(22) PCT Filed: Feb. 9, 2005

(86) PCT No.: PCT/EP2005/001272

§ 371 (c)(1),
(2), (4) Date: Apr. 9, 2007

(87) PCT Pub. No.: WO2005/090224

PCT Pub. Date: Sep. 29, 2005

(65) Prior Publication Data

US 2007/0273226 A1 Nov. 29, 2007

(30) Foreign Application Priority Data

Feb. 19, 2004 (DE) ..... 10 2004 008 552

(51) Int. Cl.
*F16C 35/06* (2006.01)
*F16C 13/04* (2006.01)

(52) U.S. Cl. ..... 384/416; 384/549; 384/559

(58) Field of Classification Search ..... 384/416, 384/420, 537, 559, 549, 562
See application file for complete search history.

(56) References Cited

U.S. PATENT DOCUMENTS 5,608,971 A 3/1997 Koivula et al.

(Continued)

FOREIGN PATENT DOCUMENTS

DE M 19790 XI/35 B 10/1956

(Continued)

OTHER PUBLICATIONS

International Preliminary Report on Patentability, from corresponding PCT Application No. PCT/EP2005/001272.

*Primary Examiner*—Marcus Charles
(74) *Attorney, Agent, or Firm*—Van Dyke, Gardner, Linn & Burkhart, LLP

(57) ABSTRACT

The invention relates to a rotor block (1) comprising a housing (2) with at least one connection surface (3A) that absorbs the load and pivot bearing seats (4) for plain and/or anti-friction bearings (5) that are designed to support a rotor (6). To dismount the rotor (6) from the housing (2), the plain and/or anti-friction bearings (5) can be dismantled from the exterior and the rotor (6) from a side (8) lying transversally to the bearings. The pivot bearing seats (4) take the form of recesses (9) that are directly configured in the housing wall, without the use of annular bodies. To facilitate the mounting and dismounting processes and to improve the precision of the rotor alignment, the pivot bearing seats (4) are configured in such a way that they form a segment greater than a semicircle around the plain and/or anti-friction bearings (5), leaving a section open on one side (8) in relation to said bearings (5), thus forming a narrowing (13).

15 Claims, 1 Drawing Sheet

U.S. PATENT DOCUMENTS 5,797,661 A * 8/1998 Lee et al. ..... 384/416
6,929,402 B1 * 8/2005 Titus ..... 384/420

FOREIGN PATENT DOCUMENTS

DE 2005949 A1 8/1971
DE 2818170 A1 11/1979
DE 3134750 A1 3/1983
DE 3724636 A1 2/1989
DE 19540217 C1 1/1997
DE 19540220 C1 4/1997
JP 7233819 A 9/1995

* cited by examiner

ROTOR BLOCK

CROSS REFERENCE TO RELATED APPLICATION

The present application claims the priority benefits of International Patent Application No. PCT/EP2005/001272, filed on Feb. 19, 2004, which is hereby incorporated herein by reference in its entirety.

FIELD OF THE INVENTION

The invention relates generally to a rotor block with a housing.

BACKGROUND OF THE INVENTION

Various kinds of rotor blocks are known, whose design provides for or allows for a replacement of the rotor in various ways.

The rotor blocks known from DE 31 34 750 C2 are formed from two halves of a bearing housing, which are welded together or otherwise joined, and have press-fitted pivot bearing seats in which the hub of the rotor is supported. The pivot bearing seats are adjoined by stop shoulders for the bearings and are oriented toward the hub. The rotor extends by its hub beyond the bearings and is in this way supported directly against the housing. The hub, moreover, has annular grooves on its outer rings at either side, intended for snap rings lying against the end faces of the bearing, and a mounting hole with an inner thread, designed for an outer thread on a drive shaft.

This design has proven itself in practice for years. However, the need still exists to minimize costs and improve function. Replacement of the rotor of DE 31 34 750 C2 is only possible by replacing the rotor block in its entirety. After replacing, the entire rotor block must be fastened by screws on the supporting framework—just as for the first-time installation. In this process, the rotor block needs to be aligned in its position relative to the supporting framework with the other rotors, so that the axis of rotation of the rotor lies at right angles to the rotor track on which the rotor moves. If the alignment step is not performed, the rotors may become ground down and, therefore, may wear out faster due to skewed running on the rotor track. Furthermore, in the application of a bridge crane, the danger exists of noticeably disrupting the movement of the bridge crane due to skewed running, impacts, and wear on wheel flanges. In addition, lateral forces are created under increasing skew angles, which place a strain greater than the operating strain on the supporting framework, etc. These issues are described at length in DIN 15018.

Another design for a rotor block is disclosed in DE 195 40 220 C1. Here, the rotor block has a housing, in which pivot bearing seats for plain and/or anti-friction bearings are provided to accommodate a rotor extending out on at least one side, and the housing can be taken apart in order to take out the rotor from one side by taking off a detachable cover, so that the housing no longer has to be loosened from the supporting framework in order to replace the rotor. However, many parts have to be loosened and tightened to install and dismount this rotor.

A further design of a rotor block is known from DE 195 40 217 C1. This design calls for the use of so-called annular bodies, which serve to accommodate the bearing in the housing walls of the rotor block. After the rotor and its hub are introduced, they are shoved from the outside onto the hub and its bearing and are secured in the housing. With these rotors, similar to those described above, the installing and dismounting involves the loosening and tightening of many parts. In particular, the annular bodies have to be removed and aligned.

While the installation and dismounting effort is less in the case of floating rotors, there is greater structural expense for the bearing, without which the necessary rigidity cannot be achieved.

From DE 195 40 217 C1, moreover, there is known a rotor block in another embodiment, wherein the bearings for the rotor are placed directly in seats that are provided in openings in the wall of the housing. To dismantle the rotor, after loosening a securing ring, the bearings are pulled out from the openings to the side. In order to remove the rotor from the housing, one has to open the circumferential seat for the bearing. Accordingly, one removes a plate closing off the housing at the side. On this plate, ridges are arranged which extend into the housing. In the installed condition of the plate, the ridges form part of the seat for the bearing. These ridges are removed from the housing with the plate. Now, the rotor with its hub stumps protruding on either side can be taken out from the housing at the side. The hub stumps fit into the space previously enclosed by the ridges.

Furthermore, an easily removable bearing system for the rotors of cranes is known from DE M 19790 XI/35b. The rotor has shaft stumps emerging on either side, on each of which is arranged an enclosed bearing. The bearings have limited movement between stopping surfaces on the shaft stump. To fasten the rotor between two parallel support plates of the crane, two sturdy, flat holding pieces are arranged on the outside of the support plates, placed at a distance from each other.

In the installed condition of the rotor, the holding pieces have disk-like recesses oriented concentrically to the shaft stumps of the rotor. In addition, downward pointing slots are arranged in the support plates and the holding plates, whose width is slightly larger than the diameter of the shaft stump. To assemble the rotor, with the enclosed bearings pushed to the outside, the shaft stumps can be introduced into the slots from underneath. The enclosed bearings are then pushed in form-fitting manner onto the shaft stumps in the direction of the respective holding plates, until they engage and form fit into their disk-shaped recesses. The enclosed bearings are then screwed together with the holding plates and support plates.

Therefore, the basic problem being solved by the present invention is to facilitate the mounting and dismounting or replacement of the rotor in a rotor block.

SUMMARY OF THE INVENTION

The present invention reduces the amount of effort required to install a rotor in a rotor block. Pivot bearing seats are configured to form a segment greater than a semicircle around the plain and/or anti-friction bearings and to leave a section of the segment open on one side in relation to the bearings, thus forming a narrowing. Furthermore, no additional fitting is needed on each side of the bearing, so that higher accuracy of rotor alignment and higher repeating accuracy in rotor replacement are achieved. As a result, fewer skew running forces are produced, and, therefore, there is less wear on the rotor.

Because the openings or bearing locations are not completely enclosed, it is possible to introduce the rotor along with the hub into the housing and then secure it by pushing on the bearing.

The openings that are not completely enclosed may have a narrowing that has slightly larger dimensions or diameter than the diameter of the hub of the rotor. The plain and/or anti-friction bearings may also be configured smaller than the openings not completely enclosed and larger than the narrowing.

Accordingly, the openings may be free at the side so that the rotor may be taken out from the side after the plain and/or anti-friction bearings have been removed sideways. In this case, the side may be the downward pointing side.

The openings may have a cross-sectional shape resembling a keyhole.

The openings of the rotor block may have a somewhat circular upper region to accommodate the plain and/or anti-friction bearing. The openings may have a lower region forming an angle that is open to the side and joined to the upper region at the narrowing. This configuration allows for securing of the bearing and high stability or absorption of the forces, as well as a secure and simple mounting and fastening of the rotor.

The cross section of the somewhat circular upper region of the openings may comprise approximately three quarters of a circle.

The connection surface may be provided on any side of the housing from which the rotor does not protrude. In particular, it may be a top connection surface, arranged at the top side of the housing.

Additional features, details and benefits of the invention will be explained by means of the following description of the drawing.

DESCRIPTION OF THE PREFERRED EMBODIMENTS

Figure 1:
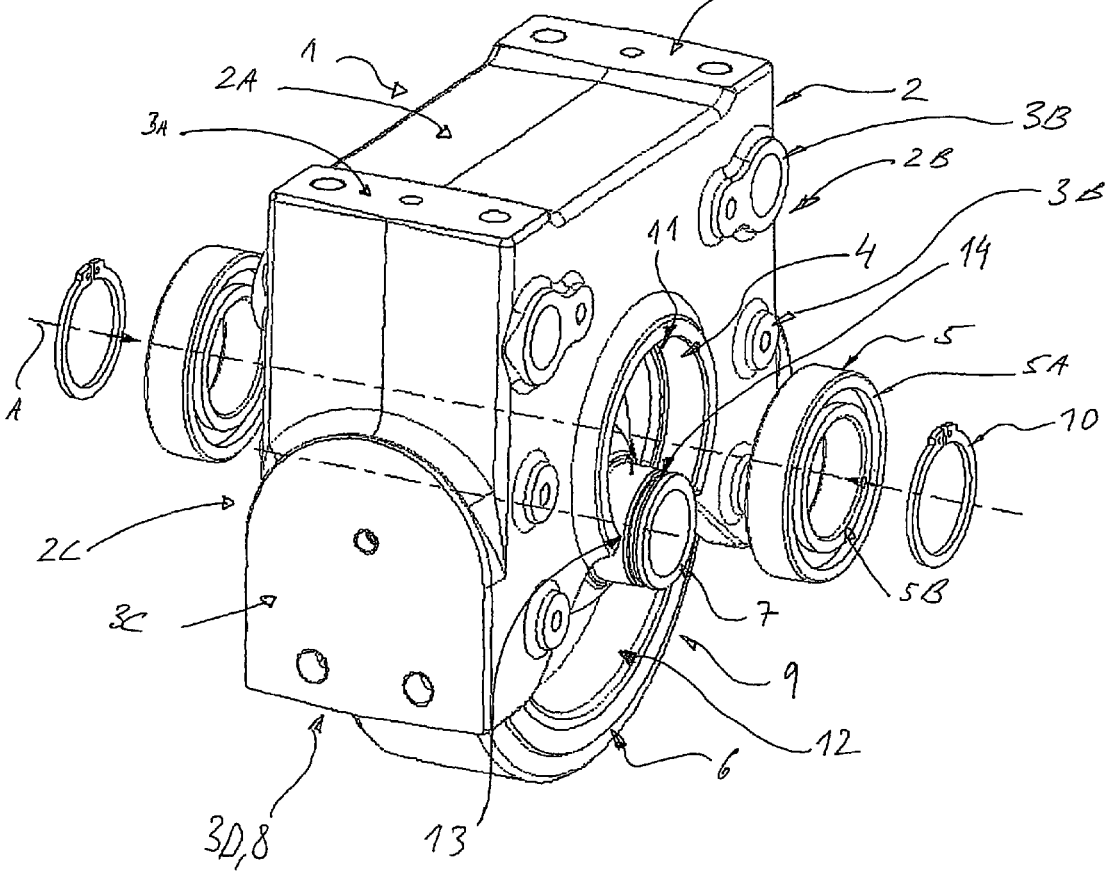
FIG. 1 is a perspective exploded view of a rotor block according to an aspect of the present invention.

As shown in FIG. 1, a rotor block 1 includes a box-shaped, single-piece housing 2. Housing 2 is open at the bottom and includes a top connection surface 3A at an upper side. Top connection surface 3A is formed by two raised surfaces lying at the outside, extending for the width of the housing and being separated in the lengthwise direction by a lower-situated region of an upper housing wall 2A.

Housing 2, moreover, has long sides 2B and end faces 2C, which likewise have raised surfaces 3B and 3C. Surfaces 3B, which surround boreholes to receive connection bolts, serve as bearing surfaces. Surface 3C is used to fasten guide rollers and buffers. The bottom side is designated as 3D or 8.

In housing 2 a rotor 6 is provided, which turns about its axis A by hub 7 and extends downward, partially out of housing 2 at side 8. In the usual installation position, axis A is pointed horizontally. Hub 7 is mounted at the sides in plain and/or anti-friction bearings, which are installed in housing 2.

Pivot bearing seats 4 are provided in two long sides 2B of housing 2, being formed directly in the housing wall by the surfaces of openings 9. Openings 9 have an upper region 11, which is circular in cross section, and a lower region 12, which forms an angle open toward side 8 or bottom side 3D. Thus, openings 9 are not completely surrounded by the housing wall, and they have an approximately keyhole shaped longitudinal section. Between upper region 11, which is circular in cross section, and the lower region 12, which forms an angle open toward the bottom 8, there is a transition or narrowing 13, having a dimension that is slightly greater than the diameter of hub 7. Hub 7 may thus be introduced from the bottom into openings 9 or their upper regions 11, which are circular in cross section.

In upper region 11, which is circular in cross section, plain and/or anti-friction bearings 5 are press-fitted, functioning to support the ends of hub 7. In the assembled condition, both the plain and/or anti-friction bearings 5 and regions 11, into which bearings 5 are press-fitted, are aligned concentrically to the axis of rotation A of rotor 6. Accordingly, the diameters of plain and/or anti-friction bearings 5 are smaller than the diameter of upper circular regions 11 and larger than the width of narrowing 13. Thus, they do not "drop" out from the housing.

Thus, for installation, rotor 6 and hub 7 are introduced into housing 2 from the bottom, i.e., from side 8, while the ends of hub 7 extend into openings 9 and are ultimately introduced into circular regions 11.

Plain and/or anti-friction bearings 5 are then pushed sideways onto hub 7 by inner ring 5B, and are introduced into openings 9 or upper circular regions 11 by outer ring 5A, and press-fitted there into pivot bearing seats 4. Finally, securing rings 10 are placed on the ends of hub 7, engaging with corresponding grooves 14 provided in the ends of hub 7.

Due to the configuration of the rotor block 1, rotor 6 and hub 7 are mounted directly in housing 2, without requiring the use of annular bodies, which facilitates installation. There are no extra parts, such as shims, on each bearing side. Moreover, the direct mounting allows for higher precision in rotor alignment and also a higher repeating precision for rotor replacement. Thus, there are fewer skew running forces. Accordingly, there is less wear on the rotor.

LIST OF REFERENCE NUMBERS

Rotor block 1
Housing 2
Housing wall 2A
Long sides 2B
End faces 2C
Bottom side 2D
Connection surface 3A
Surface 3B, 3C
Pivot bearing seats 4
Plain and/or anti-friction bearings 5
Outer ring 5A
Inner ring 5B
Rotor 6
Hub 7
Side 8
Openings 9
Securing ring 10
Upper region 11
Lower region 12
Narrowing 13
Groove 14
Axis A

The invention claimed is:

1. A rotor block, comprising:

a housing, the housing being a single piece and generally box-shaped, and having a plurality of housing walls and at least one connection surface, the at least one connection surface adapted to absorb a load; and a plurality of axially extending pivot bearing seats formed by the housing for receiving at least one of plain bearings and anti-friction bearings, the bearings being designed to support a rotor having a hub, wherein the seats are generally the width of the bearings, and wherein the at least one of plain bearings and antifriction bearings are slidably dismantled from the rotor hub axially from an exterior of the housing and the rotor is dismantled from open sections at a downward side of the housing transverse to the bearings to dismount the rotor from the housing;

wherein the plurality of pivot bearing seats form openings directly configured in respective ones of the housing walls, without the use of annular bodies, wherein the plurality of pivot bearing seats have upper regions that form segments around the at least one of plain bearings and anti-friction bearings and lower regions that form the open sections for dismantling the rotor in relation to the bearings, the segments being greater than a semicircle, the open sections formed at a narrowing of the openings that is larger than a diameter of the hub of the rotor, wherein the open sections are pointing perpendicularly downward; and wherein the at least one of plain bearings and anti-friction bearings are smaller than the segments and larger than the open sections.

2. The rotor block per claim 1, wherein the openings are free at the side, wherein the rotor is taken out from the downward side after the at least one of plain bearings and anti-friction bearings are removed sideways.

3. The rotor block per claim 1, wherein the openings have a cross-sectional shape resembling a keyhole.

4. The rotor block per claim 1, wherein the at least one connection surface is a top connection surface.

5. The rotor block per claim 1, wherein the openings are free at the downward side, wherein the rotor is taken out from the downward side after the at least one of plain bearings and anti-friction bearings are removed sideways.

6. The rotor block per claim 5, wherein the openings have a cross-sectional shape resembling a keyhole.

7. The rotor block per claim 6, wherein the openings have circular upper regions to accommodate the at least one of plain bearings and anti-friction bearings.

8. The rotor block per claim 7, wherein the openings have a lower region forming an angle, the angle being open to the side and joined to the circular upper regions at the narrowings.

9. The rotor block per claim 8, wherein a cross section of the circular upper regions of the openings comprises approximately three quarters of a circle.

10. The rotor block per claim 8, wherein the at least one connection surface is a top connection surface.

11. A rotor block, comprising:

a housing having a plurality of housing walls and at least one connection surface, the at least one connection surface adapted to absorb a load; and a plurality of axially extending pivot bearing seats formed by the housing for receiving at least one of plain bearings and anti-friction bearings, the bearings being designed to support a rotor having a hub, wherein the seats are generally the width of the bearings, and wherein the at least one of plain bearings and antifriction bearings are slidably dismantled from the rotor hub axially from an exterior of the housing and the rotor is dismantled from open sections at a perpendicularly downward side of the housing transverse to the bearings to dismount the rotor from the housing;

wherein the plurality of pivot bearing seats form openings directly configured in respective ones of the housing walls, without the use of annular bodies, wherein the plurality of pivot bearing seats have circular upper regions that form segments greater than a semicircle around the at least one of plain bearings and anti-friction bearings and lower regions that form the open sections for dismantling the rotor in relation to the bearings, the open sections formed at a narrowing of the openings, wherein the circular upper regions of the openings accommodate the at least one of plain bearings and anti-friction bearings, and wherein the open sections form an angle, the angle being open to the downward side and joined to the circular upper regions at the narrowings.

12. A rotor block, comprising:

a housing having a plurality of housing walls and at least one connection surface, the at least one connection surface adapted to absorb a load; and a plurality of axially extending pivot bearing seats formed by the housing for receiving at least one of plain bearings and anti-friction bearings, the bearings being designed to support a rotor having a hub, wherein the seats are generally the width of the bearings, and wherein the at least one of plain bearings and antifriction bearings are slidably dismantled from the rotor hub axially from an exterior of the housing and the rotor is dismantled from open sections at a perpendicularly downward side of the housing transverse to the bearings to dismount the rotor from the housing;

wherein the plurality of pivot bearing seats form openings directly configured in respective ones of the housing walls, without the use of annular bodies, wherein the plurality of pivot bearing seats have circular upper regions that form segments greater than a semicircle around the at least one of plain bearings and anti-friction bearings and lower regions that form the open sections for dismantling the rotor in relation to the bearings, the open sections formed at a narrowing of the openings, wherein the circular upper regions of the openings accommodate the at least one of plain bearings and anti-friction bearings, and wherein a cross section of the circular upper regions of the openings comprises approximately three quarters of a circle.

13. A rotor block, comprising:

a housing having a plurality of housing walls and at least one connection surface, the at least one connection surface adapted to absorb a load;

a plurality of axially extending pivot bearing seats formed by the housing for receiving at least one of plain bearings and anti-friction bearings, the bearings designed to support a rotor having a hub, wherein the seats are generally the width of the bearings, and wherein the at least one of plain bearings and antifriction bearings are slidably dismantled from the rotor hub axially from an exterior of the housing and the rotor is dismantled from open sections at a perpendicularly downward side of the housing transverse to the bearings to dismount the rotor from the housing;

wherein the plurality of pivot bearing seats form openings directly configured in respective ones of the housing walls, wherein the openings each have an upper region that forms a segment around the at least one of plain bearings and anti-friction bearings and lower regions that form the open sections for dismantling the rotor in relation to the bearings, the segments being greater than a semicircle, the open sections formed at a narrowing of the openings, wherein the at least one of plain bearings and anti-friction bearings are smaller than the segments and larger than the narrowings; and wherein the openings are free at the downward side to allow removal of the at least one of plain bearings and anti-friction bearings and the rotor from the downward side.

14. The rotor block per claim 13, wherein the upper regions of the openings comprise circular upper regions to accommodate the at least one of plain bearings and anti-friction bearings.

15. A rotor block, comprising:

a housing having a plurality of housing walls at least one connection surface, the at least one connection surface adapted to absorb a load;

a plurality of axially extending pivot bearing seats formed by the housing for at least one of plain bearings and anti-friction bearings, the bearings designed to support a rotor having a hub, wherein the seats are generally the width of the bearings, and wherein the at least one of plain bearings and antifriction bearings are slidably dismantled from the rotor hub from an exterior of the housing and the rotor is dismantled from open sections at a perpendicularly downward side of the housing transverse to the bearings to dismount the rotor from the housing;

wherein the plurality of pivot bearing seats form openings directly configured in respective ones of the housing walls, wherein the openings each have a circular upper region that forms a segment around that at least one of plain bearings and anti-friction bearings and lower regions that form the open sections for dismantling the rotor in relation to the bearings, the segments being greater than a semicircle the open sections formed at a narrowing of the openings, wherein the at least one of plain bearings and anti-friction bearings are smaller than the segments and larger than the narrowings; and wherein the openings are free at the downward side to allow removal of the at least one of plain bearings and anti-friction bearings and the rotor from the downward side, and wherein the lower regions form an angle, the angles being open to the downward side and joined to the circular upper regions at the narrowings.

* * * * *